United States Patent [19]

Riley

[11] Patent Number: 4,553,362

[45] Date of Patent: Nov. 19, 1985

[54] PREFABRICATED BUILDING UNITS

[75] Inventor: Victor Riley, Mississauga, Canada

[73] Assignee: Imperial Oil Limited, Toronto, Canada

[21] Appl. No.: 458,392

[22] Filed: Jan. 17, 1983

[30] Foreign Application Priority Data

Jan. 19, 1982 [CA] Canada ..... 394414

[51] Int. Cl.[4] ..... E04H 1/00; E04B 1/04

[52] U.S. Cl. ..... 52/236.3; 52/602; 52/653; 52/659

[58] Field of Search ..... 52/602, 653, 79.7, 236.5, 52/79.8, 79.1, 79.11, 79.14, 236.4, 651, 236.3, 659

[56] References Cited

U.S. PATENT DOCUMENTS

| | | | |
|---|---|---|---|
| 1,851,137 | 3/1932 | MacMillan | 52/236.5 |
| 2,358,758 | 9/1944 | Eames | 52/653 |
| 2,691,291 | 10/1954 | Henderson | 52/79.7 |
| 4,010,579 | 3/1977 | Galvagni | 52/79.8 |
| 4,019,293 | 4/1977 | Armas | 52/79.11 |
| 4,211,043 | 7/1980 | Coday | 52/602 |

FOREIGN PATENT DOCUMENTS

| | | | |
|---|---|---|---|
| 1104083 | 6/1955 | France | 52/651 |
| 1518637 | 2/1968 | France | 52/79.11 |
| 1034101 | 6/1966 | United Kingdom | 52/236.4 |

*Primary Examiner*—James L. Ridgill, Jr.

*Attorney, Agent, or Firm*—Robert F. Delbridge; Arne I. Fors

[57] ABSTRACT

A prefabricated building unit is formed as an integrally moulded body of fibre-reinforced concrete. The body has a wall, a beam extending along the top or bottom of the wall, and a floor or roof extending from the beam perpendicularly to the wall at the bottom or top thereof respectively. The beam is reinforced by reinforcing bars extending there along and an elongated reinforcing member extending helically around the reinforcing bars.

11 Claims, 7 Drawing Figures

98
96
106
104
12
102
100
110
108
122
124
118
120
128
58
56
22
20
24
26
18
28
30
80
78
70
74
16
68

PREFABRICATED BUILDING UNITS

This invention relates to prefabricated building units and to prefabricated buildings, such as domestic homes, constructed with such units.

Many attempts have been made in the past to design prefabricated building units which can be readily assembled to form a prefabricated building. However, the difficulties encountered with the design of prefabricated building units intended for use in the construction of domestic homes have not previously been successfully overcome. Such difficulties include for example the provision of prefabricated building units which are readily transported and assembled with one and other to form a building which is of adequate strength and which at the same time has the necessary asthetic features necessary for a domestic home. If such difficulties are increased if a building of more than one storey is to be constructed.

It is therefore an object of the invention to provide a prefabricated building unit which overcomes the above mentioned difficulties and which is especially useful in the construction of domestic homes.

According to the invention, a prefabricated building unit comprises an integrally moulded body of fibre-reinforced concrete, the body having a wall portion, a beam portion extending along the top or bottom of the wall portion, and a floor or roof portion extending from the beam portion perpendicularly to the wall portion at the bottom or top thereof respectively, the beam portion being reinforced by reinforcing bars extending there along and an elongated reinforcing member extending helically around the reinforcing bars.

The use of fibre-reinforced cement in combination with the helically-reinforced horizontal beam portion extending along the junction of the wall portion and the floor and roof portion enables the unit to have adequate strength without being unduly massive and thus to have acceptable appearance and to be readily connectable to adjacent units to form a prefabricated building suitable for use as a domestic home. Also, prefabricated building units of the present invention can be used to produce a prefabricated building with a roof which does not require any supporting pillars or columns in the central area, so that the interior of the building may be subdivided by non-load bearing partitions in any desired manner. Another advantage of the present invention is that the prefabricated building units can be readily used to produce a prefabricated building of more than one storey by stacking one series of units on top of a lower series of units.

Integrally moulded body may have a second wall portion extending perpendicularly to the first wall portion at one end thereof, and a second beam portion extending along the bottom or top of the wall portion and being integral with the floor or roof portion, the second beam portion also having reinforcing bars extending there along and an elongated reinforcing member extending helically around the reinforcing bars.

The wall portion may have integral ribs on one face of the wall portion extending from the top to the bottom thereof, and at least one of these ribs may be reinforced by at least one reinforcing member extending there along. The ribs may be on the outer face or the inner face of the wall portion.

The floor or roof portion may have integral ribs extending across one face, and at least one rib may be reinforced by at least one reinforcing member extending there along. The ribs may be on the upper face or the lower face of the floor or roof portion.

A prefabricated building structure may comprise four building units in accordance with the invention, each building unit having a rectangular floor or roof portion and the units being arranged in the form of a rectangle with the wall portions forming an external wall, and the first wall portion of each unit abutting the second wall portion of an adjacent unit.

A two-storey prefabricated building may comprise a first such building structure forming a lower storey, and a second such building structure on top of the first building structure and forming a second storey, with the units of the second storey being in staggered relationship relative to the units of the first storey such that the vertical planes of abutment of the units of the second storey are staggered with respect to vertical planes of abutment of the units of the lower storey.

One embodiment of the invention will now be described, by way of example, with reference to the accompanying drawings, of which:

Figure 1:
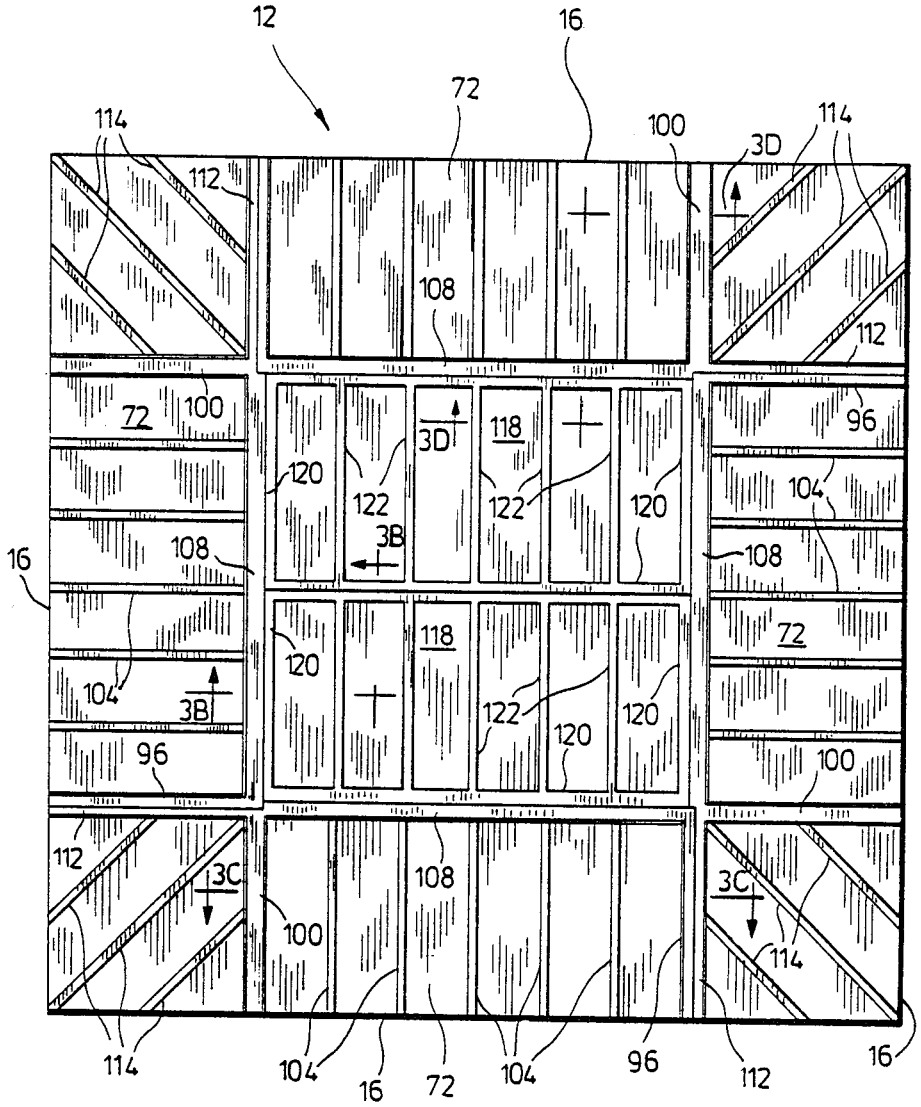
FIG. 1 is a plan view of a two-storey prefabricated building.

Referring to the drawings, a two-storey prefabricated building, has a lower storey 10 and an upper storey 12, a lower storey 10 being formed by four prefabricated building units 14, and the upper storey 12 being formed by four prefabricated building units 16.

Each lower prefabricated building unit 14 is an integrally moulded body of fibre-reinforced concrete, for example concrete reinforced by fibres such as alkali-resistant chopped glass strands. Each lower prefabricated building unit 14 has a first wall 18 and a beam 20 extending along the bottom of the wall 18, and a floor 22 extending from the beam 20 perpendicularly to the wall 18 at the bottom thereof. The beam 20 extends for the length of the building unit 14, and is reinforced by 4 spaced parallel metal reinforcing bars 24 which extend for the length of the beam 20, and by a reinforcing wire 26 wound spirally around the reinforcing bars 24 and extending over the length thereof.

The top of the wall 18 has an inwardly projecting ledge 28 shaped to support an upper unit, which will be described later, the ledge 28 being reinforced by a pair of spaced parallel reinforcing bars 30. At one end of the wall 18, an inwardly projecting column 32 with two reinforcing bars 34 extends upwardly for the height of the wall 18. The wall 18 also has a series of horizontally-spaced inwardly-projecting vertical ribs 36 extending between upper ledge 28 and the beam 20 at the bottom.

The ribs 36 are positioned in groups of three. Between the first and second groups of ribs 36, an inwardly projecting column 38 with a pair of reinforcing rods 40 is provided. Between the second and third groups of ribs 36, an inwardly projecting column 42 with four reinforcing bars 44 and helical reinforcing wire 46 is provided.

At the opposite end of the wall 18 to the column 32, an inwardly projecting column 48 extends for the height of the wall 18, the column 48 having reinforcing bars 50 and a helical reinforcing wire 52.

A second wall 54 extends from the column 48, the second wall 54 having a helically reinforced beam 20 at the bottom integral with the floor 22, an upper ledge 28 ribs 36 and an end column 32, these elements being similar to the elements with the same reference numerals referred to earlier. The floor 22 has the same length as the wall 18 and the same width as the length of the wall 54. A beam 56 with two reinforcing bars 58 projects downwardly from the edges of the floor 22 opposite the walls 18, 54.

Each upper prefabricated building unit 16 is an integral moulding of fibre-reinforced concrete in the same manner as the lower building unit 14 and has a first wall 68, a beam 70 extending along the top of the wall 68, and a roof 52 extending along the beam 70 perpendicularly to the wall 68 at the top thereof. Beam 70 extends for the length of the unit 16, and is reinforced by four spaced parallel reinforcing bars 74 which extend for the length of the beam 70 and by a reinforcing wire 76 wound spirally around the reinforcing bar 74 and extending over the length thereof.

Figure 2:
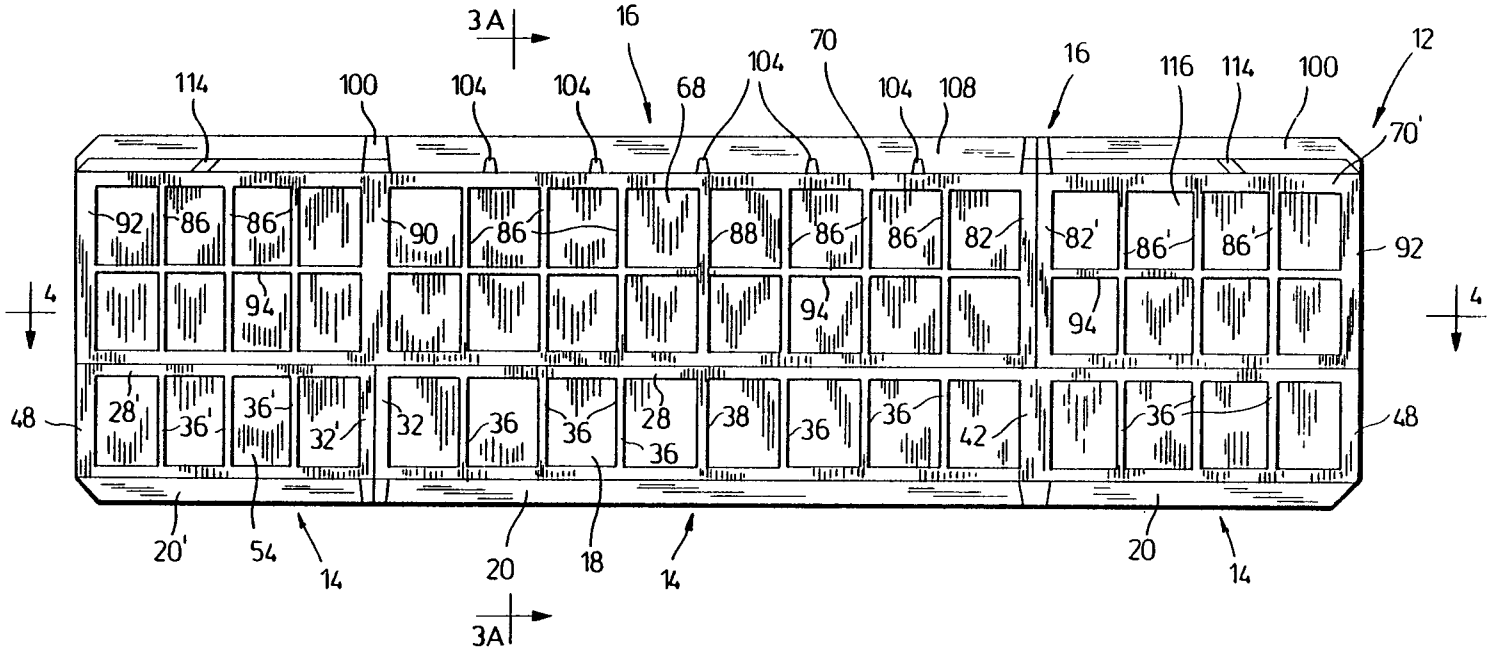
FIG. 2 shows a front view of the prefabricated building, with windows and doors being omitted for clarity

The bottom of the wall 68 has an inwardly projecting ledge 78 shaped for engagement with the ledge 28 of the lower unit 16, the ledge 78 being reinforced by a pair of spaced reinforcing bars 80. At one end of the wall 68, an inwardly projecting column 82 similar to the column 32 of the lower unit 14 extends upwardly for the height of the wall 68. The wall 68 also has a series of horizontally-spaced inwardly-projecting vertical ribs 86 extending between the beam 70 at the top and the lower edge 78 at the bottom. The ribs 86 are positioned in groups of three, between the first and second groups of ribs 86 (taken from the right in FIG. 2), and inwardly projecting reinforced column 88 similar to the column 38 of the lower unit 14 as provided. Between the second and third groups of ribs, an inwardly projecting helically-reinforced column 90 similar to the column 42 of the lower unit 14 is provided.

At the opposite end of the wall 68, a column 92 similar to the column 48 of the lower unit is provided. The wall 68 is also provided with an internally projecting horizontal rib 94 which extends from the column 82 to the column 92 through the ribs 86, the column 88 and the column 90.

The roof 72 of the upper unit 16 has an upwardly projecting beam 96 with reinforcing bars 98 at one end aligned with the column 82 of the wall 68. The roof 72 also has the beam 100 parallel to the beam 96 and reinforced with four reinforcing bars 102, the upwardly projecting beam 100 being aligned with the column 90 of the wall 68. Between the beam 96 and the beam 100, the roof 72 has five equally spaced beams 104 reinforced with two reinforcing bars 106.

The edge of the roof 72 remote from the wall 68 has an upwardly projecting beam 108 extending from the beam 96 to the beam 100 and integral with the ends 104 the beam 108 being reinforced by four reinforcing bars 110.

From the beam 100 to the other end of the roof 72, the edge of the roof 72 opposite the wall 68 has an upwardly upstanding beam 112 similar to the beam 96. Three beams 114 similar to the beams 104 extend diagonally from the beams 100, 112 to the edges of the roof 72.

A second wall 116 extends from the column 92, the second wall 16 having a helically reinforced beam 70—at the top integral with the roof 72, a lower ledge 78—, ribs 86—, horizontal rib 24—, and an end column 82—, these elements being similar to elements with the same but unprimed reference numerals referred to earlier.

The lower prefabricated building units 14 and the upper prefabricated building units 16, are arranged to form a two high storey building in the same manner as that generally described in Canadian Pat. No. 945,323 issued Apr. 16, 1974, to Raymond Felson, with the units of the second storey being in staggered relationship relative to the units of the first storey such that the vertical planes of abutment of the units of the second storey are staggered with respect to vertical planes of abutment of the lower storey.

Figures 3A, 3B, 3C, 3D:
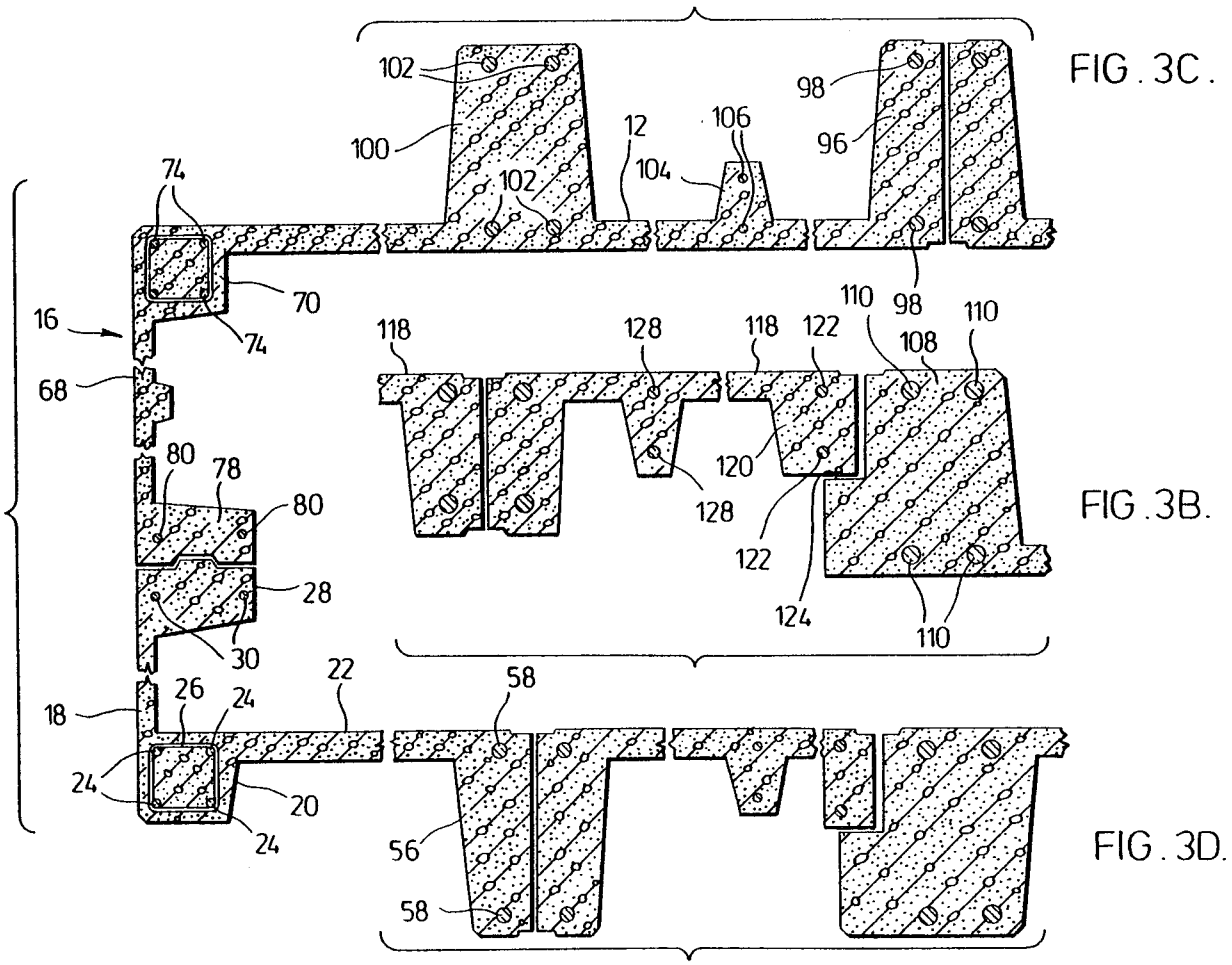
FIGS. 3A to 3D show vertical sectional views taken along the corresponding lines indicated in FIGS. 1 and 2.
Figure 4:
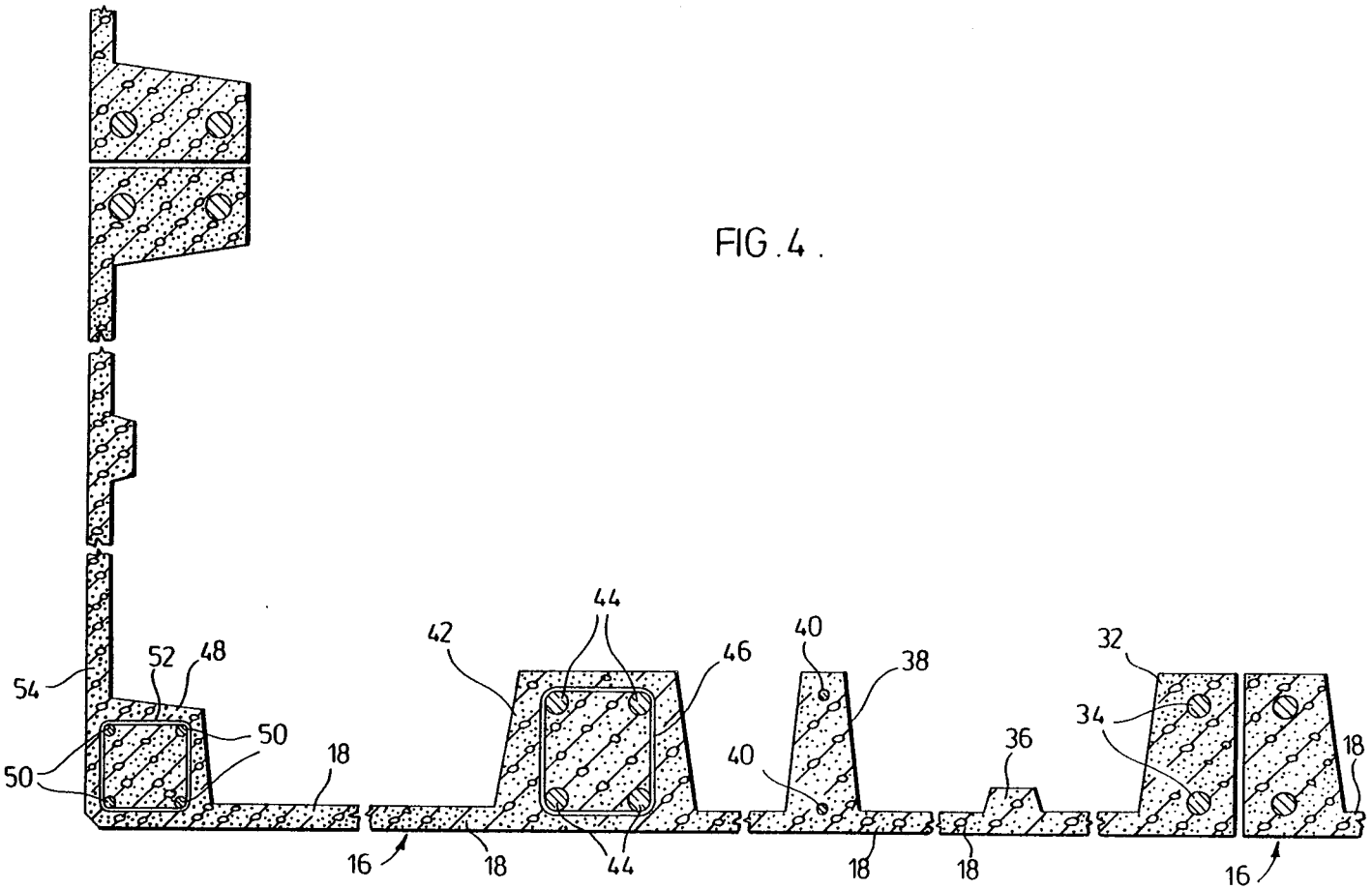
FIG. 4 shows horizontal sectional views taken along the line 4—4 indicated in FIG. 2

FIGS. 3 and 4 clearly show the manner in which the various units either are supported by one and other or abut in a manner which enables appropriate connecting devices to be readily secured thereto.

After assembly of the building units, the central open roof area is closed by two roof panel 118, also of fibre-reinforced concrete, with downwardly projecting beams 120 reinforced by reinforcing bars 122 extending along three sides of the roof panels 118 and which rest on ledges 124 provided on beams 108 of adjacent roof portions 72. The roof panels 118 are reinforced by a series of equally spaced downwardly projecting beams 126 reinforced by two reinforcing bars 128.

It will be noted that the length of each prefabricated building unit 14 or 16 is approximately three times the width of its corresponding floor 22 or roof 72. A particular advantage of this construction is that it enables the building to be constructed in such a manner that the various roof portions have minimal moment. In any event, the use of fibre-reinforced concrete in combination with the helically reinforced horizontal roof beams 70 enables the described upper and lower prefabricated building unit to be of adequate strength while having relatively thin walls, floors and a roof. For example, the wall 68 may be as thin as 2.5 cms. (about 1") and the floor 22 or roof 72 may be as thin as 4 cms (about 1.5").

A person skilled in the art will also readily appreciate that the building units of the present invention are readily caste by use of appropriately shaped moulds, and can be readily transported and assembled.

Other embodiments of the invention will be apparent to a person skilled in the art, the scope of the invention being defined in appended claims.

What I claim as new and desire to protect by Letters Patent of the United States is:

1. A prefabricated building unit comprising an integrally moulded body of fibre-reinforced concrete, said body having a wall portion, a beam portion extending along the top of the wall portion, and a roof portion extending from the beam portion perpendicularly to the wall portion at the top thereof, said beam portion being reinforced by reinforcing bars extending therealong and an elongated reinforcing member extending helically around the reinforcing bars to minimize the moment of the roof portion.

2. A prefabricated building unit according to claim 1 wherein at least some of the ribs are reinforced by at least one reinforcing bar extending there along.

3. A prefabricated building unit according to claim 1 wherein the integrally moulded body has a second wall portion extending perpendicularly to the first wall portion at one end thereof, and a second beam portion extending along the top of the second wall portion and being integral with the roof portion, said second beam portion also being reinforced by reinforcing bars extending therealong and an elongated reinforcing member extending helically around the reinforcing bars to minimize the moment of the roof portion.

4. A prefabricated building structure comprising four building units according to claim 3, each building unit having a rectangular roof portion and the units being arranged in the form of an open rectangle with the wall portions forming an external wall, and the first wall portion of each unit abutting the second wall portion of an adjacent unit.

5. A prefabricated building unit according to claim 1 wherein the wall portion has integral ribs on one face and extending from the top to the bottom thereof.

6. A prefabricated building unit according to claim 5 wherein the ribs are on the outer face of the wall portion.

7. A prefabricated building unit according to claim 5 wherein the ribs are on the inner face of the wall portion.

8. A prefabricated building unit according to claim 1 wherein the roof portion has integral ribs extending across one face thereof.

9. A prefabricated building unit according to claim 8 wherein at least one rib is reinforced by at least one reinforcing bar extending there along.

10. A prefabricated building unit according to claim 8 wherein the ribs are on the upper face of the roof portion.

11. A prefabricated building unit according to claim 8 wherein the ribs are on the lower face of the roof portion.

* * * * *